US005353205A

United States Patent [19]

Hudak

[11] Patent Number: 5,353,205

[45] Date of Patent: Oct. 4, 1994

[54] COCKPIT BLACKOUT SEARCH & SURVIVAL LIGHT

[76] Inventor: H. John Hudak, 2392 E. Market St., Akron, Ohio 44312

[21] Appl. No.: 11,237

[22] Filed: Jan. 29, 1993

[51] Int. Cl.[5] ..... F21L 15/14

[52] U.S. Cl. ..... 362/105; 362/62; 362/106; 362/191; 2/200.2

[58] Field of Search ..... 362/62, 105, 106, 191, 362/234, 253, 206, 207, 201; 381/187, 188; 2/209.2, 6, 422

[56] References Cited

U.S. PATENT DOCUMENTS

| | | | |
|---|---|---|---|
| 2,289,488 | 7/1942 | Dritsas | 240/59 |
| 2,534,179 | 12/1950 | Peterson et al. | 240/6.45 |
| 2,539,104 | 1/1951 | Rodel | 128/22 |
| 4,360,930 | 11/1982 | Blanchard | 362/105 X |
| 4,462,064 | 7/1984 | Schweitzer | 362/191 X |
| 4,634,936 | 1/1987 | Gentry et al. | 315/307 |
| 4,734,834 | 3/1988 | Petzl et al. | 362/105 X |
| 4,969,069 | 11/1990 | Eichost | 362/105 |
| 5,083,246 | 1/1992 | Lambert | 362/62 |

*Primary Examiner*—Stephen F. Husar

*Attorney, Agent, or Firm*—Oldham, Oldham, & Wilson Co.

[57] ABSTRACT

A lightweight, compact lighting device, which may be detachably, rotatably attached to an earpiece of a pilot's earphone headset or to a military pilot's helmet, is primarily designed for use by pilots in the event of a blackout in the cockpit of an aircraft. The search and survival light is convenient to switch off and on by simply rotating a switch activator near the front of the device. The lighting device may be constructed separately for attachment to an earphone or it may be manufactured as an integral portion of a headphone earpiece. In another embodiment, a bracket is included for holding a compass and the device includes a fibre optic cable to light to the compass.

14 Claims, 3 Drawing Sheets

COCKPIT BLACKOUT SEARCH & SURVIVAL LIGHT

FIELD OF THE INVENTION

This invention pertains to a lighting device primarily for use in aircraft in the event of an emergency, such as an electrical blackout in the cockpit, to enable the pilot to read the instrument panel during such emergency. The lightweight, compact lighting device may be rotatably and detachably affixed to headpiece worn by a person. More particularly, the device may be attached to the earpiece of a headphone set, a military pilot's helmet, affixed to clothing or a uniform, or manufactured as an integral part of a pilot's headphone set or military pilot's helmet.

BACKGROUND OF THE INVENTION

Various types of portable light devices are disclosed in the prior art. For example, U.S. Pat. No. 2,289,488 to Dritsas, discloses a flashlight construction for placement on the forehead above the eyes, and adapted for use by surgeons during blackouts when no other light is available.

U.S. Pat. No. 2,534,179 to Peterson, discloses a purse light, which uses a pin for to attach a flashlight along its longitudinal aspect for use to direct a light beam.

U.S. Pat. No. 2,539,104 to Rodel discloses a forehead lamp for medical purposes with the light source positioned to direct a light beam along the eye level of the user.

U.S. Pat. No. 3,634,936 to Gentry discloses a power pack and light device for the mining industry and includes safety designs for use where gases in the environment may tend to become explosive.

The foregoing devices do not, however, fulfill the requirement of pilots flying an airplane at night, particularly in stormy weather, who may experience the loss of lighting within the cockpit and resultant inability to read the instrument panel. FAA Regulations require that all pilots should have an independent backup light or an external light in the cockpit in case of blackout or other emergency conditions.

However, the ordinary situation is that the FAA required backup light may not have been stored in the proper location. A pilot will often forget where he left the flashlight and will likely experience the loss of crucial seconds for locating it. In such emergency situations, it is not unusual for a pilot to try to hold the flashlight in place by clenching it in his teeth to free his hands for manning the aircraft controls. This, of course, interferes with a pilot's ability to communicate vocally. Others may try to hold the flashlight under their arm as they scan the control panel and man the controls. A blackout in the cockpit of an aircraft is a frightening experience. It is life threatening. As such, there is an urgent necessity for a compact, lightweight lighting device attachable to a pilots standard gear for convenient use in the event of cockpit blackout.

Since a pilot must remain in constant communication with air traffic controllers earphone headsets are required to be worn by pilots. While an aviator's earphone headset is part of a pilot's standard gear, it is usually a component of the aircraft and is left in the plane when a pilot goes off duty or departs to a different flight. Attachment of an emergency lighting device to a headpiece, which headpiece may be the earpiece of a pilot's earphone headset or a military pilot's helmet containing earphones, would assure availability of light when urgently needed.

This is an important feature to aid a pilot in an emergency, by freeing his hands to control the aircraft. This lighting device would be of invaluable assistance to pilots in an emergency; it would be like having a third hand in the cockpit. Pilots who have experienced blackout conditions in the cockpit confirm that in such emergencies, pilots need all that modern technology and aeronautics can provide. Yet in a blackout emergency in the cockpit, pilots may currently lack the most fundamental element required to ensure safety, an independent lighting device.

SUMMARY OF THE INVENTION

Therefore, there is found a need for an emergency light specifically adapted for ready use by pilots in the event of a power outage and blackout in the cockpit.

Thus, a primary object of the invention is the provision of a compact, lightweight lighting device with a means for detachably connecting the device to the headpiece worn by a person, which headpiece connection may be to the surface of one or both earpieces of a headphone set or to a military pilot's helmet containing earphones.

An additional object is providing a means for rotating the lighting device on the axis of the means for detachably connecting the lighting device and the headpiece, such that the device may be used by an aircraft pilot to read his charts as well as to see the control panel during a blackout.

Yet another object of the invention is to provide a lighting device which is manufactured or molded integrally with the earpiece or earphone of a headset commonly worn by an aircraft pilot or manufactured or molded integrally with a military pilot's helmet. This is an important and advantageous feature of the invention, because during blackouts in a nighttime flight, there would be no illumination of the control panel except for the cockpit search and survival light which is the subject hereof.

A further object of the invention is the incorporation in the lighting device of a convenient means to switch the lighting device on and off.

Yet another object of the invention is the provision of a means for spreading the light over a broad area of an aircraft control panel.

A further objective is to provide a means for conveniently changing lenses, and various colored lenses for use with the lighting device according to an individual pilot's choice on which colored lens would maximize his vision in blackout conditions.

Another object is to provide a reflector in the lighting device, whereby the device projects a soft, even, floodlight, unlike the common flashlights which include pattern distortions in the light beam.

A still further object of the invention, when the device is constructed as a separable lighting device which can be detachably affixed to a headpiece, or when the lighting device is incorporated as an integral part of a pilot's earpiece or helmet in manufacture, is the incorporation of design features such that the front portion of the light projects forward of the headpiece, earpiece or helmet to avoid obstructing the light with the headphone set or the pilot. Furthermore, such design, ensures that light projected from the device is on eye level, remains on the same axis, and maintains the same range as a pilot turns his head.

These and other objects are accomplished by providing a cockpit blackout search and survival lighting device having a hollow case or casing of sufficient size to hold a battery. The case has front and back portions and includes a removable back housing which interfits the back of the case for retaining the battery in the case.

The back housing preferably includes a cylindrical compartment which extends inwardly into the case to hold a spare bulb for the lighting device. A spring is included between the back housing, or the spare bulb compartment which extends inward from the back housing, and the battery, in order to bias that battery toward the front of the lighting device.

The battery is in contact with a bulb for the lighting device and the bulb is movably inserted into the switch assembly. The bulb has a stem portion and a conductive washer or flange which projects from the stem. And the bulb is surrounded and insulated by a non-conductive cuff which is displaced in the switch assembly, whereby the bulb stem and flange are insulated from the conductive exterior wall of the switch assembly. The bulb and surrounding non-conductive cuff are adapted for longitudinal movement relative to the switch assembly within the collar.

The narrow end of the funnel shaped reflector abuts against the non-conductive cuff. A lens is positioned over the wider portion of the reflector, and both reflector and lens are retained in position by the lens focusing cap.

When the lighting device is completely assembled, the spring, the battery, the non-conductive cuff and the bulb it surrounds are collinear and those components are normally pressed down by the lens focusing cap toward the back of the case, against the bias of the spring. However, with the slightest loosening of the lens focusing cap, the biased battery in alignment with the cuff and bulb move forward until a conductive flange projecting from the stem of the bulb to form a first terminal of the switch means, contacts the conductive wall of the switch assembly which is forward of the normal position of the conductive washer. The circuit through the battery, the switch and bulb is thereby closed to energize the lighting device.

Attaching the device to a headpiece, which may be one or both earpieces of a headphone set commonly worn by an aircraft pilot or a military pilot's helmet containing earphones, is preferably accomplished by providing a circular, flat base, having upper and lower surfaces, with an upstanding, cylindrical stud projecting from the upper surface of the base. The lower surface of the base is affixed to the earpiece or helmet with an adhesive. A ridge which projects around the circumference of the stud near its outer end. And a shaft having an aperture formed therein includes a groove in the interior wall of the aperture, whereby the stud can snap into the aperture. The lighting device is thereby rotatable, to 360° if necessary, while retained on the earpiece or helmet by being snap locked against the surface of the earpiece or helmet, since the ridge on the stud interfits the corresponding groove of the aperture. The device may also include a VELCRO fastening means for affixing the lighting device to an earpiece of a headphone, military pilot's helmet, a person's clothing or uniform.

The lighting device can be used for applications other than as an aid to pilots. For example, this lighting device would be useful to joggers to attach to their earphones while running. It would also be useful to scouts while hiking, and further, useful to boaters, marine boat skippers and fishermen.

BRIEF DESCRIPTION OF THE DRAWINGS

The present invention will be best understood by reference to the accompanying drawings, wherein.

DETAILED DESCRIPTION OF THE PREFERRED EMBODIMENTS

Figure 1:
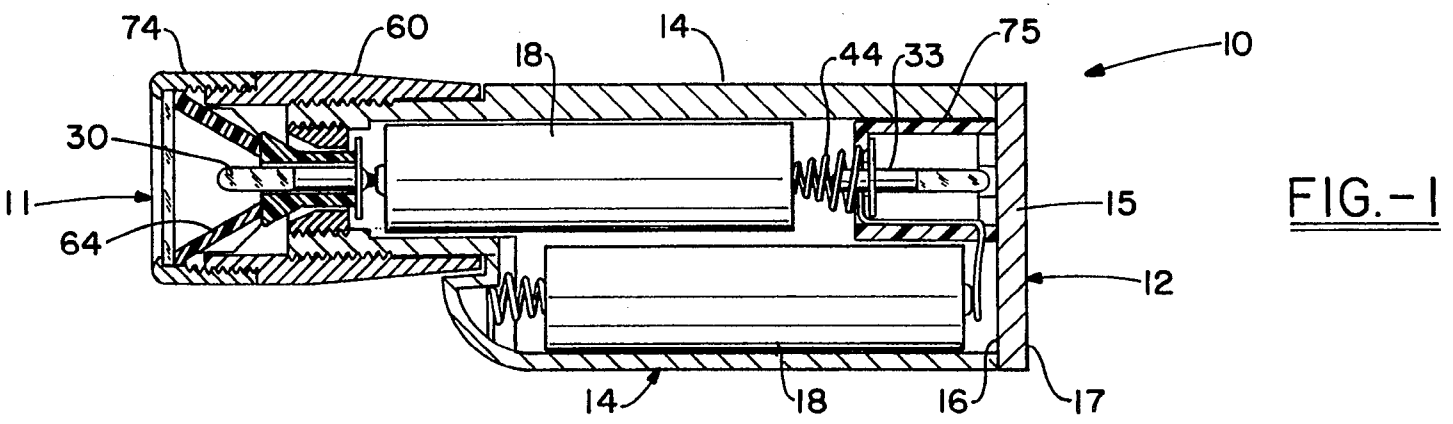
FIG. 1 is a side plan view generally depicting the lighting device in assembled array.
Figure 4:
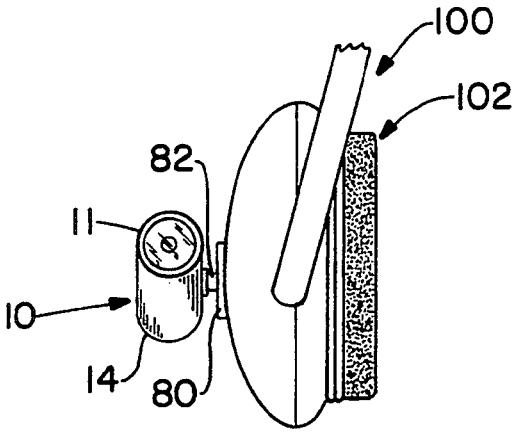
FIG. 4 is a front view of the device of this invention attached to the outside of a pilots' headphones.

The present invention as illustrated in FIG. 1, is a lightweight, compact lighting device 10 primarily intended for use by pilots to see the control panel or to read charts during a storm or blackout conditions. The lighting device may be constructed as a separate element, as shown in FIG. 1, for attachment to a headpiece 99, which may be one or both earpieces 102 of a headphone set 100, see FIG. 4, FIG. 5, and FIG. 7, or the surface of a military pilot's helmet 104 (FIG. 9) containing earphones. Alternatively, the lighting device may be affixed to clothing or a uniform (not shown).

In another embodiment shown in FIG. 6, the lighting device may preferably be manufactured as an integral component of the earpiece of an earphone headset commonly worn by a pilot or to the surface of a military pilot's helmet containing earphones, as will be discussed further below.

Figure 2:
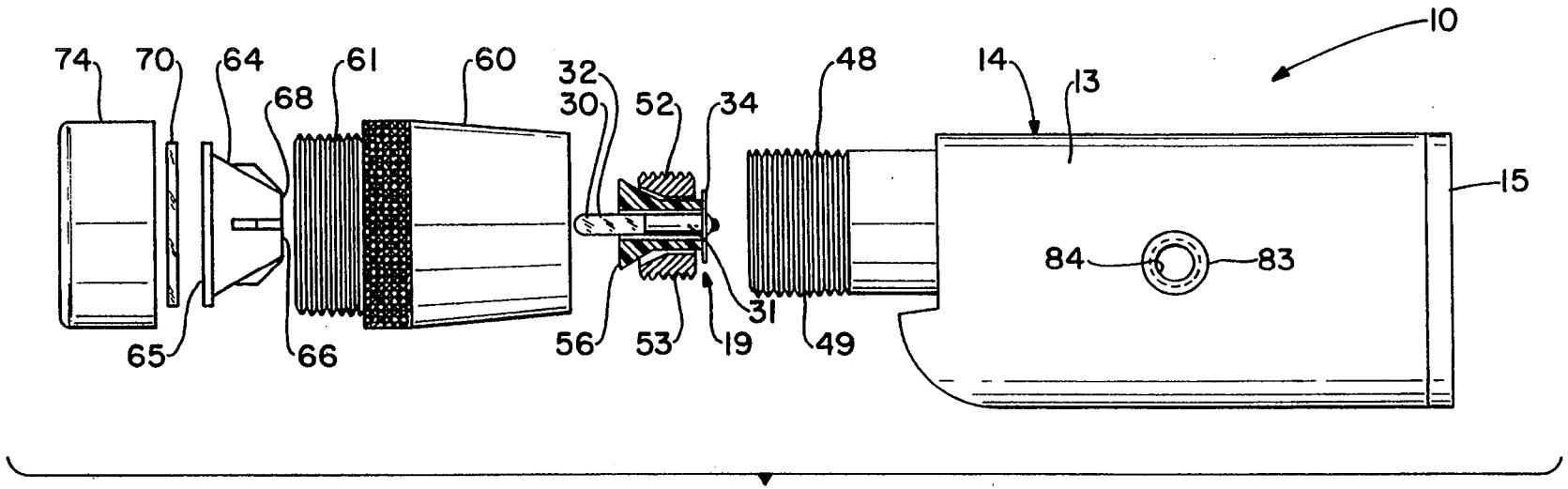
FIG. 2 shows is an exploded view showing general positioning of the components of the lighting device.

Referring now to FIGS. 1 and 2, the lighting device 10 has front 11 and back 12 portions, sides 13, with the light source, bulb 30, positioned near the front of the device. The bulb is connected in series in the electrical circuit to a power source, a battery, 18, and a switch means 19. The switch means 19 includes a first terminal which is a conductive washer or flange 34 which projects from the stem portion 31 of the bulb 30. A second terminal is formed by the conductive exterior wall 53 of a switch assembly 52. The switch means 19 is in open position when the terminals 34,53 are not in contact and closed when the conductive washer or flange 34 contacts the second terminal, the conductive exterior wall 53 of the switch assembly 52.

The bulb 30 includes a lighting portion 32 and a conductive, cylindrical stem portion 31 and there appears on the stem a conductive washer or flange 34 projecting around the circumference of the stem. The power source may, of course, consist of one or more batteries, while the electrical circuit of the device preferably contains no wires but is simply formed by contact between the battery, two terminals of switch means and the bulb.

The housing for the lighting device is a hollow case 14 with suitable dimensions for holding the battery 18 and the switch means 34,53. A back housing 15, with inner and outer surfaces 16,17, is interfitted to the back 12 of the case 14. There is provided a tubular collar 48 which projects outward at the front 11 of the case 14 which has interior (not shown) and exterior threading 49.

Also, the hollow switch assembly 52 having the conductive exterior wall 53 with threads which serves as the second terminal 23 of a switch means 19 for the circuit, has a non-conductive internal portion (not shown). The switch assembly 52 is adapted to receive the bulb 30 and the switch means is then threaded into the collar 48.

A non-conductive, cylindrical cuff 56 is disposed in the switch assembly 52 to surround and insulate the stem 31 of the bulb 30, and the bulb and cuff are adapted for longitudinal movement within the switch assembly.

The lighting device 10 also includes a switch activator 60 with interior threads (not shown) for threadable installation on the outside of the collar 48; the switch activator also has external threads 61. A funnel shaped reflector 64, has a wide 65 and a narrow 66 portion and a large opening 67 and a smaller opening 68, such that a lens 70 can be positioned over the large opening 67 of the reflector 64 with the bulb 30 projecting through the narrow portion 66 and into the wide portion 65 of the reflector 64. The narrow end of the funnel abuts against the non-conductive cuff 56.

A focusing cap 74 having internal threads (not shown) is threadably installed on the exterior threads 61 of the switch activator 60 for securing the reflector 64 and lens 70 in position at the front 11 of the device 10. In a preferred embodiment of the lighting device, a spring 44 is disposed between the back housing 15 and a battery 18. That battery 18 is in alignment with the bulb 30 and the non-conductive cuff 56 around the bulb to bias the battery, the aligned bulb and the cuff toward the front of the device.

The non-conductive cuff 56 and the bulb 30 it surrounds are normally pressed down toward the back of the case by the lens focusing cap. However, rotating the switch activator 60 to loosen it simultaneously releases pressure of the lens focusing cap and allows the biased battery, aligned bulb and cuff to move forward until the conductive washer or flange 34 around the stem 31 of the bulb 30 contacts the external conductive wall 53 of the switch assembly 52, whereupon the circuit is thereby closed to energize the device 10.

Figure 3:
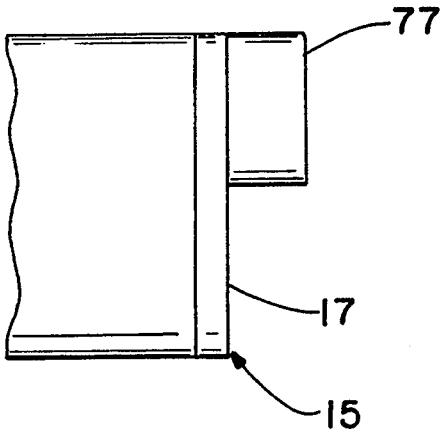
FIG. 3 is a fragmentary side plan view of an alternative embodiment of the lighting device which includes a molded bracket in the back housing of the device for retaining a compass in the bracket.
Figure 3A:
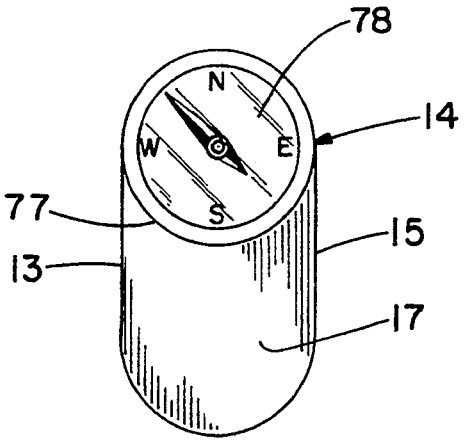
FIG. 3A is a rear view of the alternative embodiment of FIG. 3.

The lighting device may further include a cylindrical compartment 75, see FIG. 2 and FIG. 3, which extends inward into the case 14 from the inner surface 16 of the back housing 15. The cylindrical compartment 75 is dimensioned to receive and hold a spare bulb 33 for the lighting device.

When the spare bulb compartment 75 is incorporated in the device, the biasing spring 44 mentioned above may be disposed between the cylindrical compartment and a collinear battery, bulb, and non-conductive cuff, whereby, once again, the spring effectively biases those aligned components toward the front 11 of said device.

As can be seen in FIG. 3, a molded bracket 77 may also be incorporated in the device to protrude from the exterior or outer surface 17 of the back housing 15, the bracket having a generally circular shape for receiving and holding a compass 78 therein.

Figure 8:
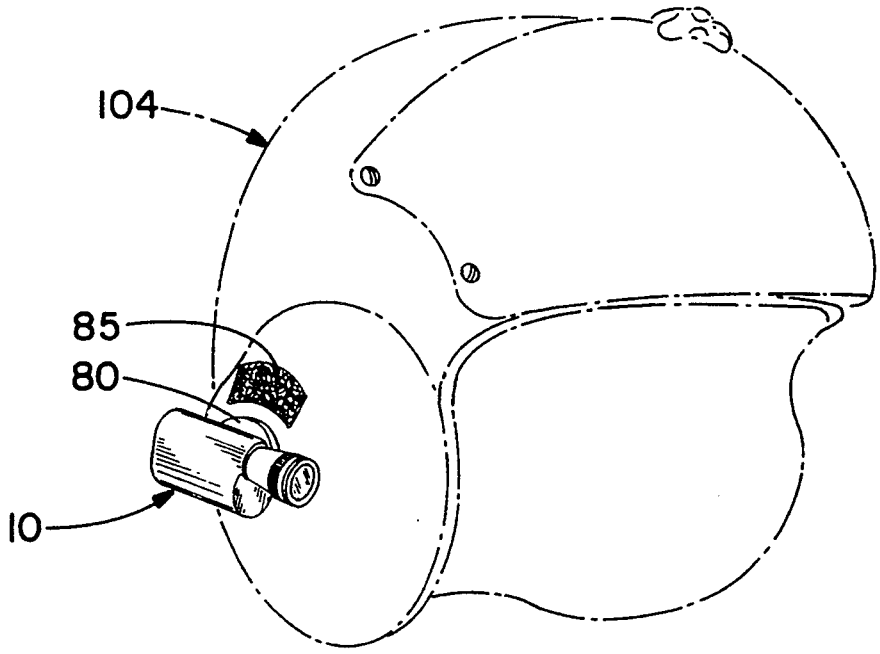
FIG. 8 is an elevational view of a military pilot's helmet with the lighting device of this invention rotatably, detachably attached.

The lighting device is adapted for rotatable, detachable attachment to an earpiece 102 of an earphone headset 100, as shown in FIGS. 4 through 7, or to the surface of a military pilot's helmet containing earphones FIG. 8. Thus, the cockpit search and survival light incorporates a means for such attachment. The means for attaching preferably comprises a circular, flat base 80, having upper 81 and lower (not shown) surfaces, with an upstanding, cylindrical stud 82 projecting from the upper surface of the base. The lower surface of the base is affixed to the earpiece 102 or the surface of a military pilot's helmet with a very strong bonded adhesive. A ridge (not shown) projects around the circumference of the stud 82 near its outer end. And a hollow shaft 83 projects from a side 13 of the lighting device 10 and the shaft includes a groove (not shown) formed on the interior wall 84 of the shaft 83, which groove corresponds to the ridge of the stud 82, whereby the stud can snap into the hollow shaft. The lighting device is thereby rotatable, to 360° if necessary, while retained on the earpiece 102 or helmet 104, by being snap locked against the surface thereof, since the ridge on the stud interfits the corresponding groove of the aperture.

The device may also include a fastening means for affixing the lighting device to an earpiece of a headset, to a military pilot's helmet containing earphones, or to a person's clothing or uniform. As such, a piece of VELCRO, attached to the side of the lighting device, connects to another similar VELCRO piece 85 adhered to the side of an earphone or a helmet containing earphones for detachable attachment of the lighting device to an earphone or helmet. The VELCRO piece on the lighting device may be positioned to surround the hollow shaft, so that a lighting device can be rotatably attached by snap locking to the earpiece or helmet, or in the alternative, the same device could be affixed to the earpiece or helmet by means of the VELCRO.

Figure 5:
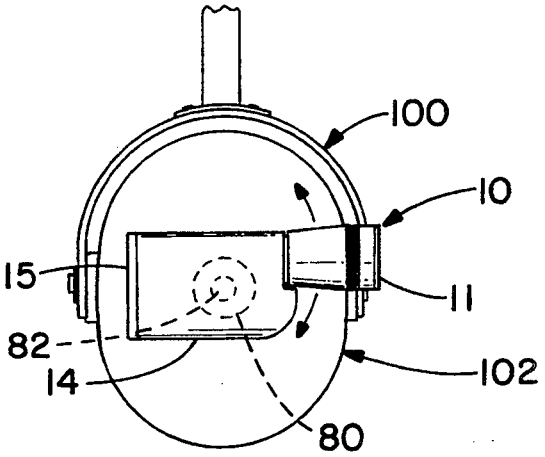
FIG. 5 is a side view of the device indicating convenient positioning of the lighting device by attachment to headphones of a pilot.
Figure 6:
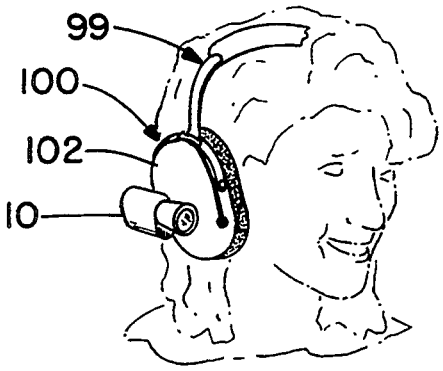
FIG. 6 is an elevation view of a headpiece worn by a person with the lighting device of this invention mounted on an earpiece.
Figure 7:
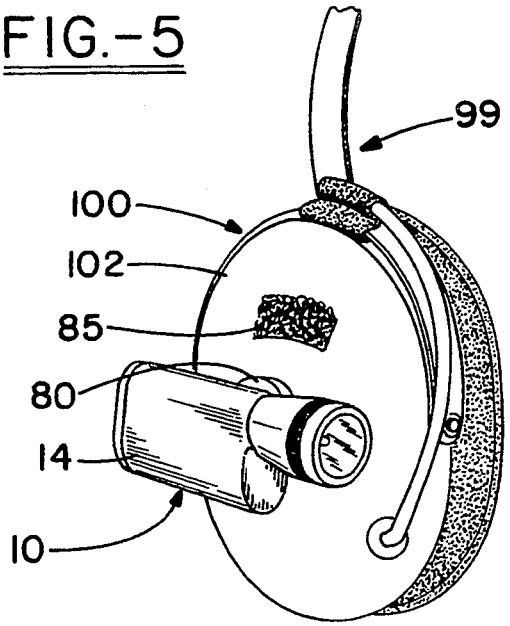
FIG. 7 is an elevation view of a headpiece, showing the subject lighting device attached to an earpiece of a headphone set and, also, indicating the fastening means, a second VELCRO piece adhered to the surface of an earpiece.

In another embodiment shown in FIGS. 5 through 7, the cockpit search and survival lighting device 10 of the invention is preferably constructed as part of the earpiece 102 and remains for use as an integral component of that earpiece 102 of the headphone set 100.

In this embodiment, the earpiece 102 and lighting device 10 are designed so that tubular collar portion 48 of the device extends outward and forward of the earpiece 102 to avoid obstruction of the projected light by the earpiece 102, headphone set 100 or the pilot. Such design configuration provides light to be projected from the device on eye level of a pilot, which light remains on that same axis and range as a pilot turns his head. Similarly, the device may be manufactured or molded as an integral component of a military pilot's helmet containing earphones (See FIG. 8).

The device may further comprises fibre optic wire (not shown) having first and second ends, with first end disposed near the bulb, and the second end positioned near the compass for transmitting light from the bulb to the compass by means of the fibre optic wire.

While there have been shown and described the preferred embodiments of a cockpit search and survival light in accordance with the invention, it will be appreciated that many changes and modifications may be made therein without, however, departing from the essential spirit and scope of the invention.

I claim:

1. A lighting device, comprising:

front and back portions and sides, an electronic circuit with a light source, said light source positioned near the front of the device, connected in series to a power source and a switch means within the device, the switch means having first and second terminals and open and closed positions;

wherein the light source is a bulb with a lighting portion and a conductive stem portion, said stem having a conductive flange projecting from the stem; said flange serving as a first terminal for the switch means; and wherein further the power source comprises at least one battery;

a means for attaching associated with a side of the device for rotatably, detachably attaching the lighting device to a headpiece worn by a person;

a hollow case with suitable dimensions for holding the at least one battery and the switch means;

a removable back housing, with inner and outer surfaces, interfitted to the back of the case;

a tubular collar with interior and exterior threading projecting outward at the front of the case;

a hollow switch assembly having a conductive exterior wall to serve as the second terminal for said switch means, and exterior threads whereby said switch assembly is threaded into the collar; said switch assembly further having a non-conductive internal portion; said switch assembly adapted to receive the bulb;

a non-conductive cuff displaced in the switch assembly to surround and insulate the stem and conductive flange of the bulb, whereby the bulb and cuff are adapted for longitudinal movement in the switch assembly;

a switch activator with interior and exterior threads threadably installed on the outside of the collar;

a funnel shaped reflector, with wide and narrow portions, a larger and a smaller opening, said reflector positioned in the switch activator with the bulb projecting through the narrow portion and into the wide portion of the reflector, and the narrow end of the reflector abutting against the non-conductive cuff;

a lens positioned over the wider opening of the funnel;

a lens focusing cap having internal threads, threadably installed over the switch activator for securing the reflector and lens in position at the front of the device; and, a spring disposed between the back housing and a battery, of said at least one battery, in alignment with the bulk and said non-conductive cuff to bias the aligned battery, of said at least one battery, the bulb and said cuff toward the front of the device.

2. The lighting device of claim 1, wherein the non-conductive cuff and bulb it surrounds are normally pressed down toward the back of the case; and loosening the switch activator allows the biased battery, of said at least one battery, the bulb and the cuff to move forward until the conductive flange contacts the conductive switch assembly, the circuit is thereby closed to energize the device.

3. The lighting device of claim 2, further comprising a cylindrical compartment positioned on the inner surface of the back housing, said compartment extending inward into the case, for holding a spare bulb for the lighting device.

4. The lighting device of claim 3, wherein said spring is disposed between said compartment of the back housing and collinear with the battery, the bulb and said non-conductive cuff, for biasing said aligned battery, of said at least one battery, the aligned bulb and the cuff toward the front of said lighting device.

5. The lighting device of claim 4, wherein a circular bracket protrudes from the exterior surface of the back housing, said bracket adapted to receive and hold a compass therein.

6. The lighting device of claim 5, wherein the means for attaching comprises:

a base with upper and lower surfaces, the lower surface of the base affixed to the headpiece, and an upstanding, stud projecting from the upper surface of the base, said stud having an outer end;

a ridge projecting around the periphery of the stud near its outer end;

a hollow shaft with an interior wall projecting from a side of the lighting device; a groove formed in the interior wall of the shaft corresponding to the ridge of the stud, whereby the stud snaplocks in the shaft for rotatable, detachable attachment of the lighting device to the headpiece.

7. The lighting device of claim 6, further comprising a fastening means formed of first and second. VELCRO pieces, said first VELCRO piece adhered to a side of the lighting device, and the second VELCRO piece adhered to the side of an headpiece for detachable attachment of the lighting device to the headpiece.

8. The lighting device of claim 7, wherein said first VELCRO piece on the lighting device is positioned to surround the hollow shaft, and said second VELCRO piece is adhered to the headpiece near said base adhered to the headpiece, whereby the lighting device can be rotatably attached by snap locking to the headpiece or fastened to the headpiece by means of the VELCRO.

9. The lighting device of claim 8, further comprising a fibre optic wire having first and second ends, said first end disposed near said bulb, and said second end positioned near said compass by transferring light from said bulb to the compass.

10. The lighting device of claim 9, wherein the headpiece is an earpiece of an earphone headset.

11. The lighting device described in claim 9, wherein the headpiece is a military pilot's helmet containing earphones.

12. A lighting device comprising: a case with front and back portions, an electronic circuit with a light source positioned near the front of the device connected in series to a power source comprising at least one battery, and a switch means, the switch means having first and second terminals and open and closed positions; a removable back housing, with inner and outer surfaces, interfitted to the back of the case; a tubular collar with interior and exterior threading projecting outward at the front of the case; a hollow switch assembly having a conductive exterior wall with threads for threading the switch assembly into said collar, said conductive wall serving as the second terminal for said switch means, said switch assembly further having a non-conductive internal portion; said switch assembly threaded into the collar and adapted to receive the bulb; a non-conductive, cylindrical cuff displaced in the switch assembly to surround and insulate the stem and conductive flange of the bulb, whereby the bulb and cuff are adapted for longitudinal movement in the switch assembly; a switch activator with interior and exterior threads threadably installed on the outside of the collar; a funnel shaped reflector, with wide and narrow portions, a larger and a smaller opening, said reflector positioned in the switch activator with the bulb projecting through the narrow portion and into the wide portion of the reflector, and the narrow end of the funnel abutting against the non-conductive cuff; a lens positioned over the wider opening of the funnel; a focusing cap having internal threads, threadably installed over the switch activator for securing the reflector and lens in position at the front of the device; and, a spring disposed between the back housing and a battery, of said at least one battery, in alignment with the bulb and said non-conductive cuff to bias said aligned battery, of said at least one battery, the bulb and said cuff toward the front of the device; wherein, said lighting device is constructed integrally with, and incorporated as a permanent component of, a headpiece worn by a person.

13. The lighting device of claim 12, wherein the headpiece is an earpiece of an earphone headset.

14. The lighting device described in claim 12, wherein the headpiece is a military pilot's helmet containing earphones.

* * * * *